United States Patent [19]

Hale

[11] Patent Number: 4,603,440

[45] Date of Patent: Aug. 5, 1986

[54] SPORT JERSEY

[76] Inventor: James M. Hale, 21100 Lemarsh, Chatsworth, Calif. 91311

[21] Appl. No.: 652,748

[22] Filed: Sep. 19, 1984

[51] Int. Cl.[4] ..... A41B 1/00

[52] U.S. Cl. ..... 2/115; 2/116; 2/123; 2/127; 2/129

[58] Field of Search ..... 2/16, 60, 115, 116, 2/123, 113, 125, 129, 170, 127, 161, 162, DIG. 1, 131, 133, 139; 66/194, 170

[56] References Cited

U.S. PATENT DOCUMENTS

| | | | |
|---|---|---|---|
| 2,300,125 | 10/1942 | Lapick | 2/139 |
| 2,643,389 | 6/1953 | Wegner | 2/170 |
| 3,154,934 | 11/1964 | Frishman | 66/194 |
| 3,466,663 | 9/1969 | Mehl | 2/65 |
| 4,047,400 | 9/1977 | Thorneburg | 66/194 |
| 4,499,741 | 2/1985 | Harris | 2/170 X |

*Primary Examiner*—Ronald Feldbaum
*Attorney, Agent, or Firm*—Koppel & Harris

[57] ABSTRACT

A jersey for motorcycle racing or other strenuous activity, with perspiration absorbent and cooling cuffs attached to the ends of the sleeves. The cuffs, which are formed from a resilient material, extend over the wearer's wrist to absorb perspiration running down the arm. The inner faces of the cuffs are made from an absorbent, uncut pile such as terry cloth, while outer cuff layers are formed from a ribbed backing material. A similar perspiration absorbent neck is also provided.

3 Claims, 3 Drawing Figures

SPORT JERSEY

BACKGROUND OF THE INVENTION

1. Field of the Invention

This invention relates to wearing apparel, and more particularly to a jersey intended to be used for competition motorcycle riding and other sports.

2. Description of the Prior Art

Competition motorcycle riding such as motocross is an extremely demanding physical activity, and often takes place under hot, dusty conditions. Due to the uneven terrain of most courses, it is important for the riders to retain a strong, secure grip on the motorcycle handles to maintain full control. This is often difficult under race conditions, since the racers can generate large amounts of perspiration which drips down their arms and onto their hands, causing a wet and less secure grip on the handlebars, as well as adding to the rider's general discomfort.

Conventional jerseys and other upper body wearing apparel typically worn by motorcycle racers have only a limited effect in reducing the effect of perspiration on the rider's control and comfort. No jerseys are currently available which are capable of effectively preventing perspiration from the upper arms from entering the grip area. It is also highly desirable that the garment not interfere with the escape of body heat.

SUMMARY OF THE INVENTION

In view of these problems associated with the prior art, the object of the present invention is to provide a jersey suitable for competitive motorcycle riding and other active sports which effectively cuts off the flow of perspiration from the wearer's upper arms to his hands, and yet allows for a rapid dissipation of body heat.

In the realization of these and other objects of the invention, a jersey is formed from an open weave material and is provided with sleeves which extend to the wrists. A cuff adapted to extend over the wearer's wrist is attached to the end of each sleeve. Each cuff is formed from a resilient material and is sized to resiliently bear against the wearer's wrist. The inner face of the cuff material comprises an absorbent, uncut pile which absorbs perspiration running down the wearer's arm.

In the preferred embodiment, the inner cuff material comprises a terry cloth having a weight in the range of 10 to 10.5 ounces per yard, with a separate ribbed backing layer on the outer surface of the cuff. The outer backing and inner cuff material are seamed together along opposite edges of the cuff, but are mutually unattached between the seams. The jersey also includes an absorbent collar, of similar construction to the cuffs, attached to the neck area.

These and other features and advantages of the invention will be apparent to those skilled in the art from the following detailed description of a preferred embodiment, taken together with the accompanying drawings, in which:

DETAILED DESCRIPTION OF A PREFERRED EMBODIMENT

Figure 1:
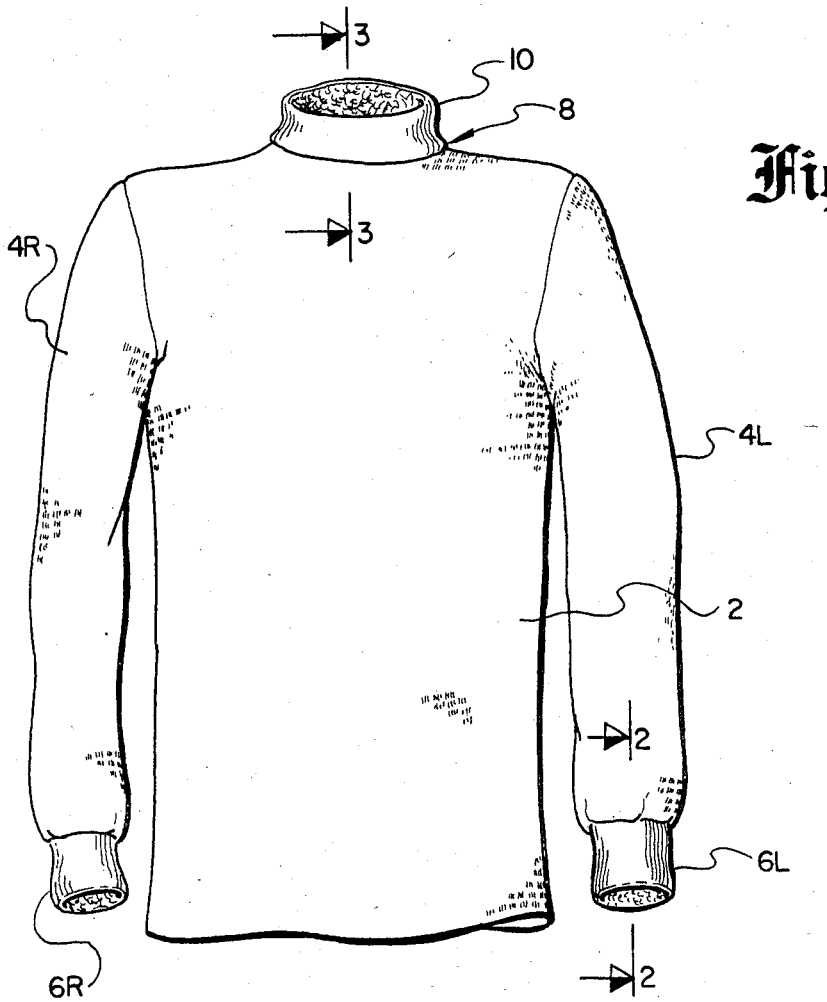
FIG. 1 is an elevational view of a sport jersey constructed in accordance with the invention.

A sport jersey constructed in accordance with the present invention is shown in FIG. 1. The jersey includes a body portion 2, and left and right sleeves 4L and 4R. To enhance cooling and evaporation while riding a motorcycle or engaging in other strenuous activity, the body and sleeves are formed from an open weave material such as a 50% cotton, 50% polyester blend with a weight in the range of 8 to 8.5 ounces per yard.

Left and right cuffs 6L and 6R are attached to the ends of the left and right sleeves 4L and 4R, respectively. The cuffs are formed from a resilient material and, when in a relaxed position as shown in FIG. 1, are small enough in diameter to resiliently bear against the wearer's wrist. As described in further detail below, the cuffs are constructed so as to absorb perspiration flowing down the wearer's arms, thereby adding to the wearer's comfort and keeping his or her hands dry for more secure gripping of the motorcycle handlebars, while at the same time promoting a cooling ventilation. The jersey's neck portion 8 includes a collar 10 which is similar in construction to the cuffs, and is attached to the jersey neck so as to promote wear and comfort.

Figure 2:
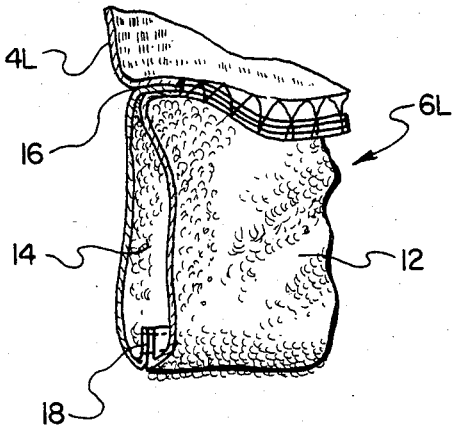
FIG. 2 is a cross-sectional view of the absorbent cuff at the end of each sleeve, taken along section line 2—2 of FIG. 1.

Referring now to FIG. 2, a cross-section of one side of cuff 6L is shown; the other cuff 6R is identical. The cuff and the sleeve to which it is attached are dimensioned so that in normal use the cuff will extend over the wearer's wrist. The cuff is formed from two pieces of material: the inner face 12 of the cuff which comes in contact with the wearer's wrist, and an outer layer of material 14. The inner and outer layers 12 and 14 are joined to the end of the sleeve 4L by a seam 16, while the opposite ends of the two layers are joined together by another seam 18.

The surface of inner cuff layer 12 which bears against the wearer's sleeve is formed from an absorbent, uncut pile material with closed fabric loops coming in contact with the wearer. This inner cuff material is preferably formed from a terry cloth having a weight in the approximate range of 10 to 10.5 ounces per yard. The terry cloth is preferably about 75%–80% cotton and 25%–20% polyester, a blend which has been found to combine positive absorbency and circulation qualities. The outer cuff layer 14 is formed from a one x one ribbed material, which allows a flow of air through the inner terry cloth layer to help dry and cool that layer. A 50% cotton, 50% polyester material with a weight of 8 to 8.5 ounces per yard is preferable.

Both the inner and outer cuff layers are resilient, and the cuff is dimensioned to be somewhat smaller in diameter than the size of the average wearer's wrist, so that the cuff is stretched and the inner absorbent layer bears against the wearer's wrist when the jersey is worn. The outer cuff layer 14 provides a protective backing for the inner layer 12, but is not attached to the inner layer except at the opposite seams 16, 18. Air circulation past the inner layer, with an accompanying cooling and drying effect, is thereby enhanced. The inner absorbent layer 12 bears against the wearer's wrist sifficiently to absorb most perspiration dripping down the wearer's arm, thus improving both the comfort and safety of the garment, but is of low enough desnity to permit a certain amount of air circulation under normal wearing conditions.

Figure 3:
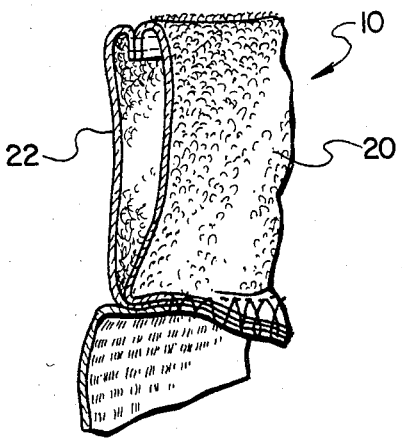
FIG. 3 is a cross-sectional view of the jersey's absorbent collar, taken along section line 3—3 of FIG. 1.

Referring now to FIG. 3, a cross-sectional view of collar 10 is shown. The collar is formed in a manner similar to the sleeve cuffs, with an inner layer 20 formed from terry cloth or other absorbent, uncut pile material, and an open weave outer layer 22. As with the cuffs, the collar materials are resilient and their dimensions are selected such that the collar bears against the wearer's neck when worn. Again, this enhances the absorption of perspiration with an improved cooling effect.

While a particualr embodiment of the improved sport jersey has been shown and described, various modifications and alternate embodiments will occur to those skilled in the art. Accordingly, it is intended that the invention be limited only in terms of the appended claims.

I claim:

1. A jersey, comprising:

a jersey formed from an open weave material and having a pair of sleeves extending to the vicinity of the wearer's wrists, and a pair of cuffs attached to the ends of the respective sleeves and adapted to extend over the wearer's wrists, each cuff comprising an inner resilient layer dimensioned to resiliently bear against the wearer's wrist, the inner layer comprising a terry cloth having a weight in the approximate range of 10 to 10.5 ounces per yard, the terry cloth having an absorbent, uncut pile adapted to absorb perspiration running down the wearer's arm, and an outer resilient layer of a ribbed material, the ribbed material having a weight in the approximate range of 8–8.5 ounces per yard and being characterized by an air porous weave that enables a flow of air to the inner terry cloth layer to dry and cool the terry cloth layer, the inner and outer layers of each cuff being formed from separate pieces of material which are seamed together along opposite edges of the cuff and mutually unattached between the seams, each cuff being joined to the end of a respective sleeve by a seam which is common to one of the seams joining the inner and outer layers.

2. The jersey of claim 1, the inner cuff layer comprising approximately 75%–80% cotton and 25%–20% polyester, and the outer cuff layer comprising approximaterly 50% cotton and 50% polyester.

3. The jersey of claim 1, the jersey including a neck portion, and further comprising a collar of similar construction to the cuffs and attached to the neck.

* * * * *